US007789320B1

(12) United States Patent
Schwartz

(10) Patent No.: US 7,789,320 B1
(45) Date of Patent: Sep. 7, 2010

(54) SAFETY STRAW

(76) Inventor: Jason P. Schwartz, 1790 NW. River Trail, Stuart, FL (US) 34994

( * ) Notice: Subject to any disclaimer, the term of this patent is extended or adjusted under 35 U.S.C. 154(b) by 272 days.

(21) Appl. No.: 11/444,687

(22) Filed: Jun. 1, 2006

Related U.S. Application Data

(60) Provisional application No. 60/642,921, filed on Jun. 9, 2005.

(51) Int. Cl.

| | |
|---|---|
| ***B05B 17/04*** | (2006.01) |
| ***E03B 9/20*** | (2006.01) |
| ***B05B 12/14*** | (2006.01) |
| ***A47G 21/18*** | (2006.01) |
| ***A61J 15/00*** | (2006.01) |
| ***F24H 9/12*** | (2006.01) |

(52) U.S. Cl. ..... 239/12; 239/11; 239/16; 239/24; 239/33; 138/37; 138/40

(58) Field of Classification Search ..... 239/33, 239/1, 11, 12, 16, 24; 138/37, 39, 40, 41, 138/111, 112, 114, 115

See application file for complete search history.

(56) References Cited

U.S. PATENT DOCUMENTS

| | | | | | |
|---|---|---|---|---|---|
| 2,531,855 | A * | 11/1950 | Loptson | ..... | 239/33 |
| 3,110,754 | A * | 11/1963 | Witort et al. | ..... | 174/70 R |
| 4,252,273 | A * | 2/1981 | Karterman | ..... | 239/33 |
| 5,427,316 | A * | 6/1995 | Leone | ..... | 239/33 |
| 5,722,590 | A * | 3/1998 | Miller | ..... | 239/33 |
| 6,142,384 | A * | 11/2000 | Shafik | ..... | 239/33 |
| 7,137,414 | B2 * | 11/2006 | Andres | ..... | 138/39 |
| 2005/0103879 | A1 * | 5/2005 | Robinson | ..... | 239/33 |

* cited by examiner

*Primary Examiner*—Len Tran
*Assistant Examiner*—Ryan Reis
(74) *Attorney, Agent, or Firm*—Frank L. Kubler

(57) ABSTRACT

A safety drinking straw includes a beverage delivery tube having a tube first end for insertion into a quantity of beverage and a tube second end for placement between user lips; and a debris blocking structure substantially at the tube first end permitting a free flow of the beverage through the delivery tube while preventing entry of debris of a selected minimum target size into the delivery tube; so that the debris blocking structure prevents debris from entering the delivery tube and thus prevents debris from lodging and becoming an obstruction within the delivery tube. The debris blocking structure preferably includes at least one cord extending across the interior of the delivery tube substantially at the tube first end, and alternatively includes at least one tube partition or at least two tubular barrels fitted longitudinally and in tandem inside and secured within the delivery tube.

5 Claims, 7 Drawing Sheets

SAFETY STRAW

FILING HISTORY

This application continues from provisional application Ser. No. 60/642,921 filed on Jun. 9, 2005.

BACKGROUND OF THE INVENTION

1. Field of the Invention

The present invention relates generally to the field of beverage retaining and dispensing devices. More specifically the present invention relates to a safety drinking straw including a beverage delivery tube having a tube first end for insertion into a quantity of beverage and a tube second end for placement between user lips, the delivery tube containing a debris blocking structure substantially at the tube first end permitting a free flow of the beverage through the delivery tube while preventing entry of debris of a selected minimum target size into the delivery tube. The placement of the debris blocking structure substantially at the tube first end includes placement at or immediately adjacent to the tube first end and is a key feature of the present invention because this construction not only prevents debris from passing through the delivery tube, but prevents the debris from entering the delivery tube altogether so that the debris cannot lodge and become an obstruction within the tube.

The debris blocking structure preferably has a line profile in lateral cross-section across the tube first end to minimize flow resistance. One preferred embodiment of the debris blocking structure providing such a line profile includes at least one tube partition extending longitudinally from the tube first end along at least part of the tube length, and optionally along the entire tube length to reach the tube second end. The tube partition also may be intermittent along the tube length. Another preferred embodiment of the debris blocking structure also providing the line profile includes at least one narrow cord extending laterally across the interior of the delivery tube at or slightly recessed into or slightly protruding from the tube first end.

2. Description of the Prior Art

The modern drinking straw was invented in 1888 by Marvin Stone, a manufacturer of paper cigarette holders. Reasoning that people would enjoy drinking lemonade through a straw, Stone designed an 8½ inch paper straw with a diameter just wide enough to prevent a lemon seed from lodging in the tube. Prior to Stone's patented invention, people drank through natural grass straws. Unfortunately, the natural straws—often cut from rye—tended to make the drink taste like grass.

The straw is ideal for iced tea as well as any drink that may contain seeds, pits, pulp or other non-liquid objects. Americans drink iced tear at an astonishing rate of 35 billion gallons per year, and this rate is growing. Nearly 80% of all tea consumed in the United States is consumed over ice. Iced tea was officially created in 1904 at the World's Fair in St. Louis and has become a truly American beverage.

As Americans becoming more health-conscious, iced tea is becoming the lunchtime beverage-of-choice. Besides being a refreshing and relaxing beverage, iced tea is fat-free, contains no calories or cholesterol, and can be caffeine-free as well. Tea also has antioxidants often found in fruits and vegetables.

Iced tea served at commercial dinning facilities is almost universally served with a straw and 95% of the time with fresh lemon. As a result, the problem of lemon (citrus) seeds entering straws has become very common.

In addition, many restaurants serve drinking water with sliced lemons or limes placed into the glass.

Non-liquid objects such as seeds, pits, pulp and ice pieces readily enter the common drinking straw. This may cause a variety of problems, including:

1. Drawing a non-liquid object such as a seed through the straw and into the mouth of the drinker. This may lead to several situations that could be avoided such as:

A. The non-liquid object can enter the trachea (wind pipe). This can cause a serious, life-threatening choking situation and even death.

B. An object such as a hard seed may be taken into the mouth and break or injure teeth or dental appliances.

C. The object being taken into the mouth may have a poor taste requiring the patron to spit out the object. This may be considered offensive or embarrassing to the patron and leave the patron with a poor experience of the product and the establishment.

D. In people having either diverticulosis or diverticulitis, eating seeds and pits may be medically contraindicated.

2. The object may wedge or lodge in the straw and thereby render the straw inoperable, requiring the use of another straw cylinder or shaft to clear the straw, adding expense.

3. The drinker may attempt to clear the straw by blowing into the straw or using his or her hands or other tools or utensils to force out the lodged object. This may be objectionable for reasons such as sanitary concerns and decorum.

Prior drinking straws have included that of D'Auguste, et al., U.S. Pat. No. 5,094,861, issued on Mar. 10, 1992, for a flavored drink straw. D'Auguste, et al., including a drinking tube containing a series of powdered flavoring within honeycombed metering chambers. These chambers do not appear to define debris barriers at tube ends.

Shafik, U.S. Pat. No. 6,142,384, issued on Nov. 7, 2000, discloses a personal portable liquid filter device. The Shafik filter is fitted over the immersed end of a drinking straw to remove impurities from water. Shafik is not suitable for blocking entry of seeds and similar debris in a beverage because it would create substantial flow resistance and may remove beverage flavor, and because it would be expensive to manufacture as part of a drinking straw.

Barley, U.S. Pat. No. 3,389,803, issued on Jun. 25, 1968, teaches an orally operable water filter. Barley includes a hollow tubular filter housing having a mouthpiece on one end adapted to be engaged by user lips and a pair of spaced filter plates which retain activated carbon and a bacteria filter within the housing opposite the mouthpiece. Dyer, U.S. Pat. No. 1,000,332, issued on Aug. 8, 1911, reveals a pocket filter containing filter material. The problems of Shafik are again presented if used for drinking beverages.

Vaiano, et al., U.S. Pat. No. 6,811,036, issued on Nov. 2, 2004, discloses a drinking straw with an integral filtration system. The filtration structure of Vaiano, et al., is located in the middle region of the straw, so that debris could enter the straw and become lodged against the filtration structure. And, in addition, the problems of Shafik are presented. Martin, U.S. Pat. No. 580,527, issued on Apr. 13, 1897, teaches a drinking tube having at one end a mouthpiece and at the other end a strainer secured to the periphery of a cup-like enlargement to form a chamber containing a ball. Martin would be complex and very expensive to manufacture and would inhibit beverage flow.

Villani, et al., U.S. Pat. No. 6,109,538, issued on Aug. 29, 2000, reveals a flavoring delivery drinking straw. Villani, et al., includes a delivery tube containing a flavoring capsule retained between two spaced apart screen barriers within the delivery tube middle section. Debris could enter the straw and become lodged against the barrier screens.

Manning, U.S. Pat. No. 5,718,681, issued on Feb. 17, 1998, discloses a medication delivery straw having a conical particle barrier protruding into one delivery tube end. Debris could enter and become lodged in the conical particle barrier.

Bengtsson, et al., U.S. Pat. No. D487,375, issued on Mar. 9, 2004, teaches a drinking straw having a flattened end which would obstruct beverage flow.

A variety of design patents have disclosed straw constructions which provide no substantially no debris obstructing benefits. Wang, U.S. Pat. No. D477,493, issued on Jul. 22, 2003, illustrates a drinking straw attachment having two diverging barrels. Gray, et al., U.S. Pat. No. D490,638, issued on Jun. 1, 2004, illustrates a paw shaped drinking straw. Diaz, U.S. Pat. No. D490,637, issued on Jun. 1, 2004, illustrates a drinking straw with a panel clipped to one end of a delivery tube, the panel having a stylized image of a human mouth. Cecere, U.S. Pat. No. D491,336, issued on Jun. 15, 2004, illustrates a combination lollipop straw having a lollipop simulating structure at one delivery tube end. Goodman, Jr., U.S. Pat. No. 332,198, issued on Jan. 5, 1993, illustrates a drinking straw apparently having a pellet contained between two barriers near but spaced from one delivery tube end.

It is thus an object of the present invention to provide a safety straw which permits a free flow of the beverage through the delivery tube while preventing entry of debris of a selected minimum target size into the delivery tube.

It is another object of the present invention to provide such a safety straw which the debris blocking structure is placed substantially at the tube first end, either at or immediately adjacent to the tube first end, to prevent debris from passing through the delivery tube while preventing the debris from entering the delivery tube altogether so that the debris cannot lodge and become an obstruction within the tube.

It is finally an object of the present invention to provide such a safety straw which is highly economical to manufacture.

SUMMARY OF THE INVENTION

The present invention accomplishes the above-stated objectives, as well as others, as may be determined by a fair reading and interpretation of the entire specification.

A safety drinking straw is provided, including a beverage delivery tube having a tube first end for insertion into a quantity of beverage and a tube second end for placement between user lips; and a debris blocking structure substantially at the tube first end permitting a free flow of the beverage through the delivery tube while preventing entry of debris of a selected minimum target size into the delivery tube; so that the debris blocking structure prevents debris from entering the delivery tube and thus prevents debris from lodging and becoming an obstruction within the delivery tube.

The debris blocking structure preferably has a cross-sectional line profile across the tube first end to minimize beverage flow resistance. The debris blocking structure preferably includes at least one cord extending across the interior of the delivery tube substantially at the tube first end. The at least one cord preferably includes a filament. The at least one cord preferably includes a bar. The at least one cord optionally includes two perpendicularly intersecting diametric filaments. The at least one cord alternatively includes two perpendicularly intersecting diametric bars. The debris blocking structure still alternatively includes at least one tube partition extending longitudinally substantially from the tube first end along at least part of the length of the delivery tube. The debris blocking structure yet alternatively includes at least two tubular barrels fitted longitudinally and in tandem inside and secured within the delivery tube. The tubular barrels may be linked together by barrel interconnecting walls.

BRIEF DESCRIPTION OF THE DRAWINGS

Various other objects, advantages, and features of the invention will become apparent to those skilled in the art from the following discussion taken in conjunction with the following drawings, in which.

DETAILED DESCRIPTION OF THE PREFERRED EMBODIMENTS

Figure 1:
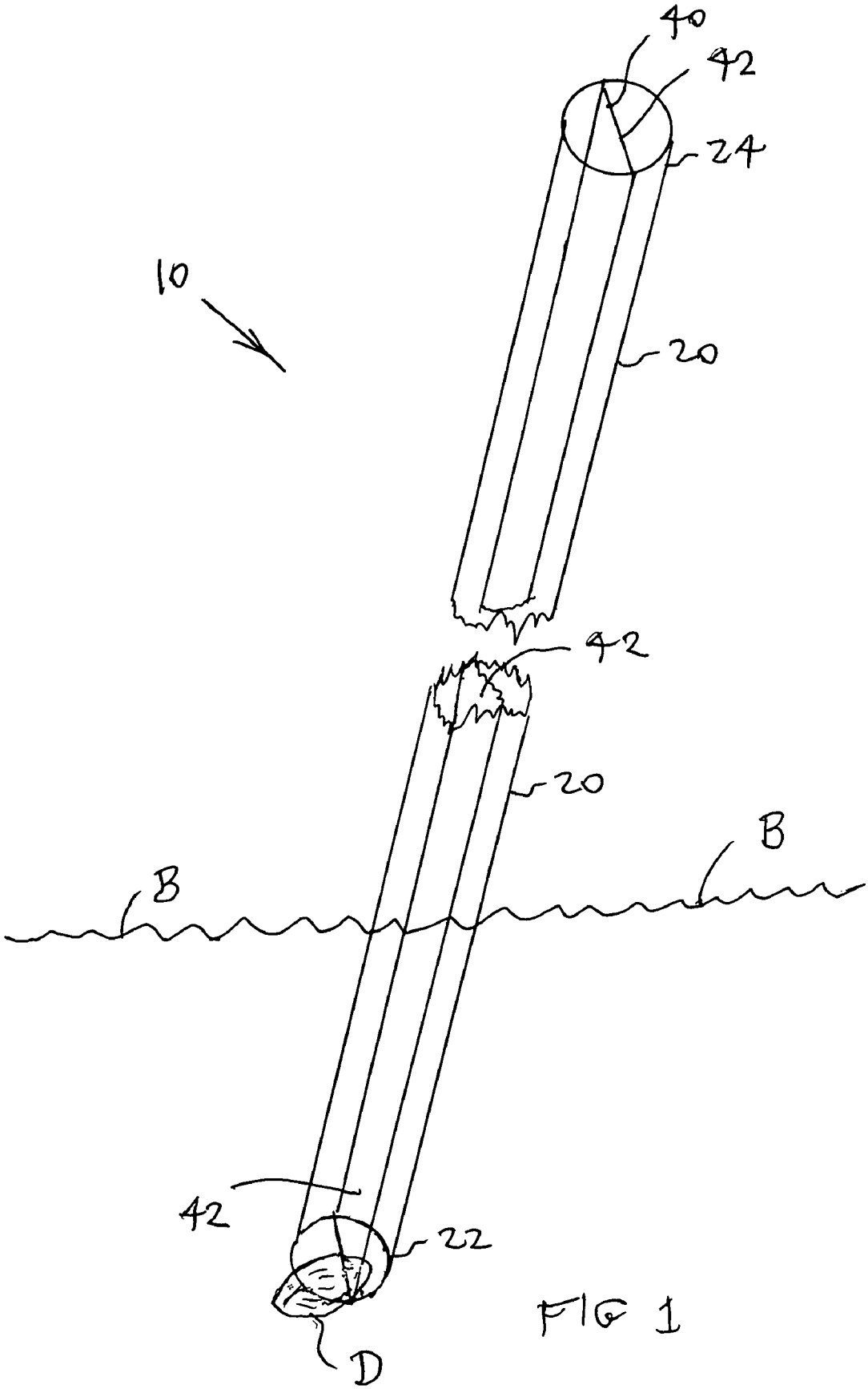
FIG. 1 is a transparent perspective view of one embodiment of the present safety straw having a partition debris blocking structure and immersed in a beverage vessel, showing debris in the form of a seed blocked at the delivery tube first end by the partition.

As required, detailed embodiments of the present invention are disclosed herein; however, it is to be understood that the disclosed embodiments are merely exemplary of the invention which may be embodied in various forms. Therefore, specific structural and functional details disclosed herein are not to be interpreted as limiting, but merely as a basis for the claims and as a representative basis for teaching one skilled in the art to variously employ the present invention in virtually any appropriately detailed structure.

Reference is now made to the drawings, wherein like characteristics and features of the present invention shown in the various FIGURES are designated by the same reference numerals.

First Preferred Embodiment

Referring to FIGS. 1-10, a safety drinking straw 10 is disclosed including a beverage delivery tube 20 having a tube first end 22 for insertion into a quantity of beverage B and a tube second end 24 for placement between user lips, the delivery tube 20 containing a debris blocking structure 40 substantially at the tube first end 22 permitting a free flow of the beverage B through the delivery tube 20 while preventing entry of debris D of a selected minimum target size into the delivery tube 20. The placement of the debris blocking structure 40 substantially at the tube first end 22 includes placement at or immediately adjacent to the tube first end 22 and is a key feature of the present invention because this construction not only prevents debris D from passing through the delivery tube 20, but prevents the debris D from entering the delivery tube 20 altogether so that the debris D cannot lodge and become an obstruction within the delivery tube 20. The debris blocking structure 40 preferably has a cross-sectional line profile across the tube first end 22 to minimize beverage flow resistance.

Figure 2:
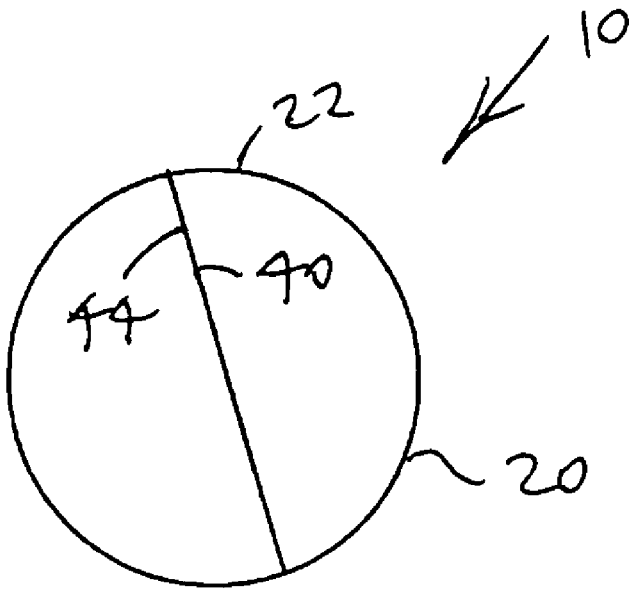
FIG. 2 is an end view of the straw delivery tube first end showing a debris blocking structure including a diametric filament.
Figure 3:
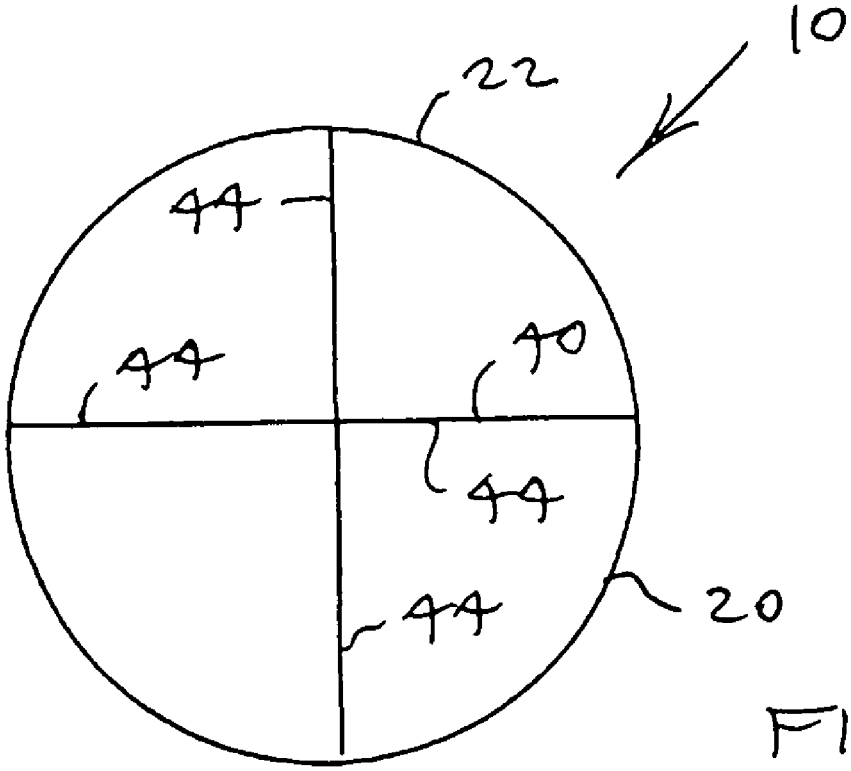
FIG. 3 is a view as in FIG. 2 showing a debris blocking structure including two perpendicular diametric filaments.
Figure 4:
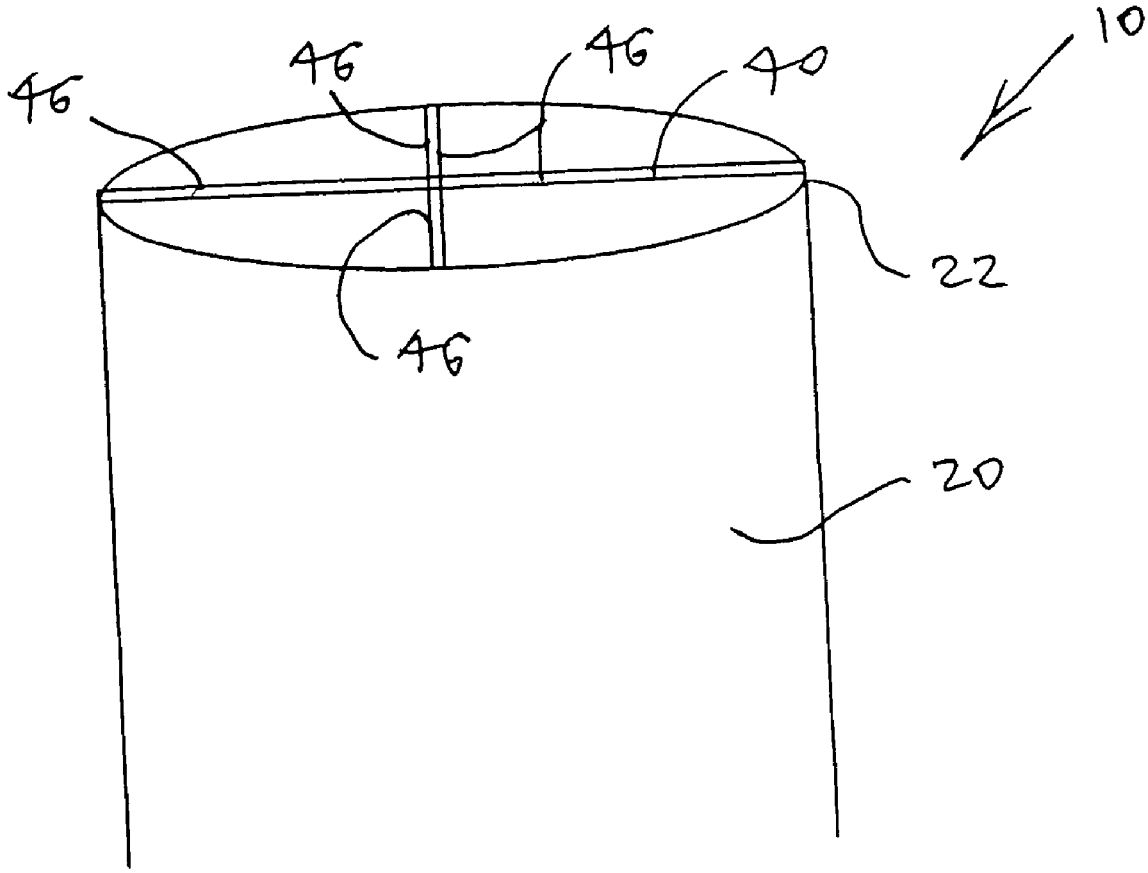
FIG. 4 is a view as in FIG. 3, except that the perpendicular diametric filaments are replaced with perpendicular diametric bars which are thicker than the filaments.
Figure 5:
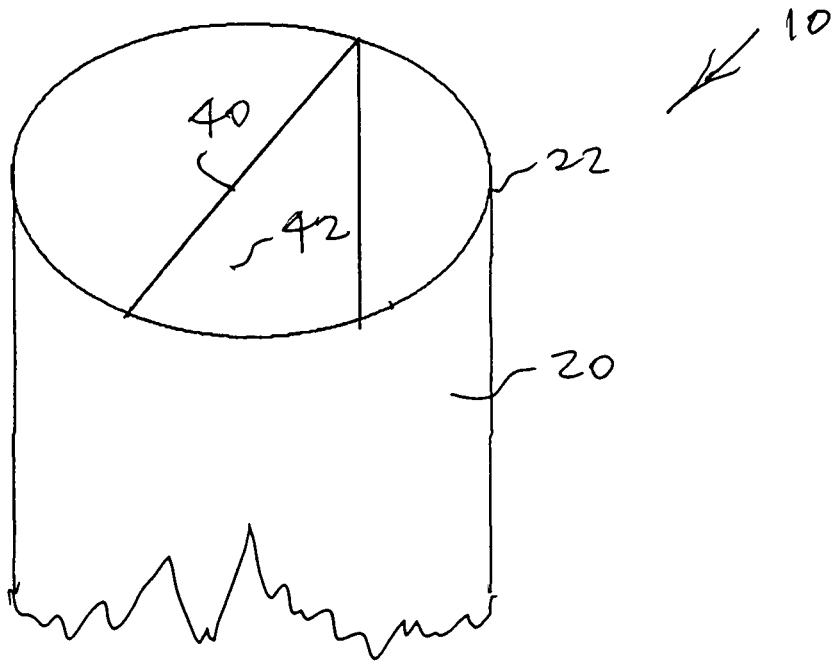
FIG. 5 is a broken away perspective view of the tube first end showing a debris blocking structure including a diametric partition wall.

One preferred embodiment of the debris blocking structure 40 providing the line profile includes at least one narrow cord in the form of a filament 44 or a thicker bar 46 extending across the interior of the delivery tube 20 at the tube first end 22. FIG. 2 shows a diametric filament 44, FIG. 3 shows two perpendicularly intersecting diametric filaments 44, and FIG. 4 shows perpendicularly intersecting diametric bars 46.

Another preferred embodiment of the debris blocking structure 40 also providing such a line profile includes at least one tube partition 42 extending longitudinally from the tube first end 22 along at least part of the tube 20 length, and optionally along the entire tube 20 length to reach tube second end 24. See FIG. 5.

Figure 6:
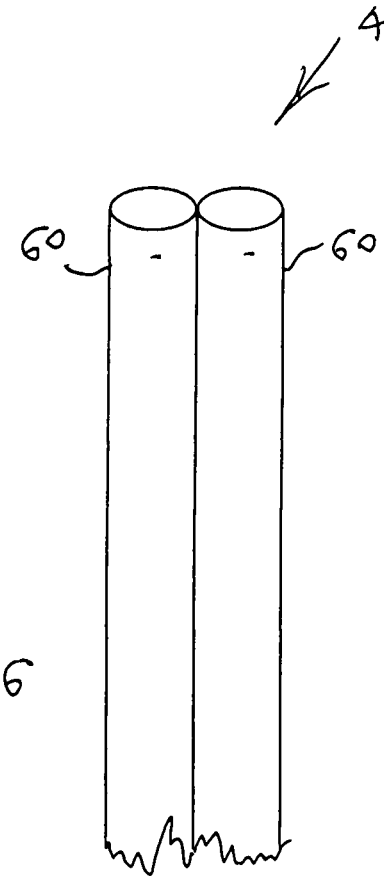
FIG. 6 is broken away perspective end view of a debris blocking structure including two barrels, themselves each a tube, for longitudinal insertion and mounting within a straw.
Figure 7:
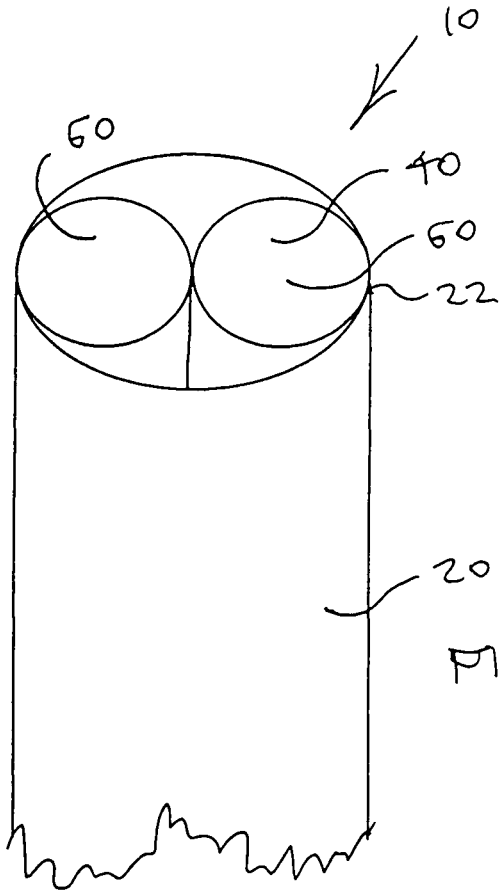
FIG. 7 is broken away perspective view of the tube first end showing the two barrels of FIG. 6 mounted within a straw to become an embodiment of the present safety straw.
Figure 8:
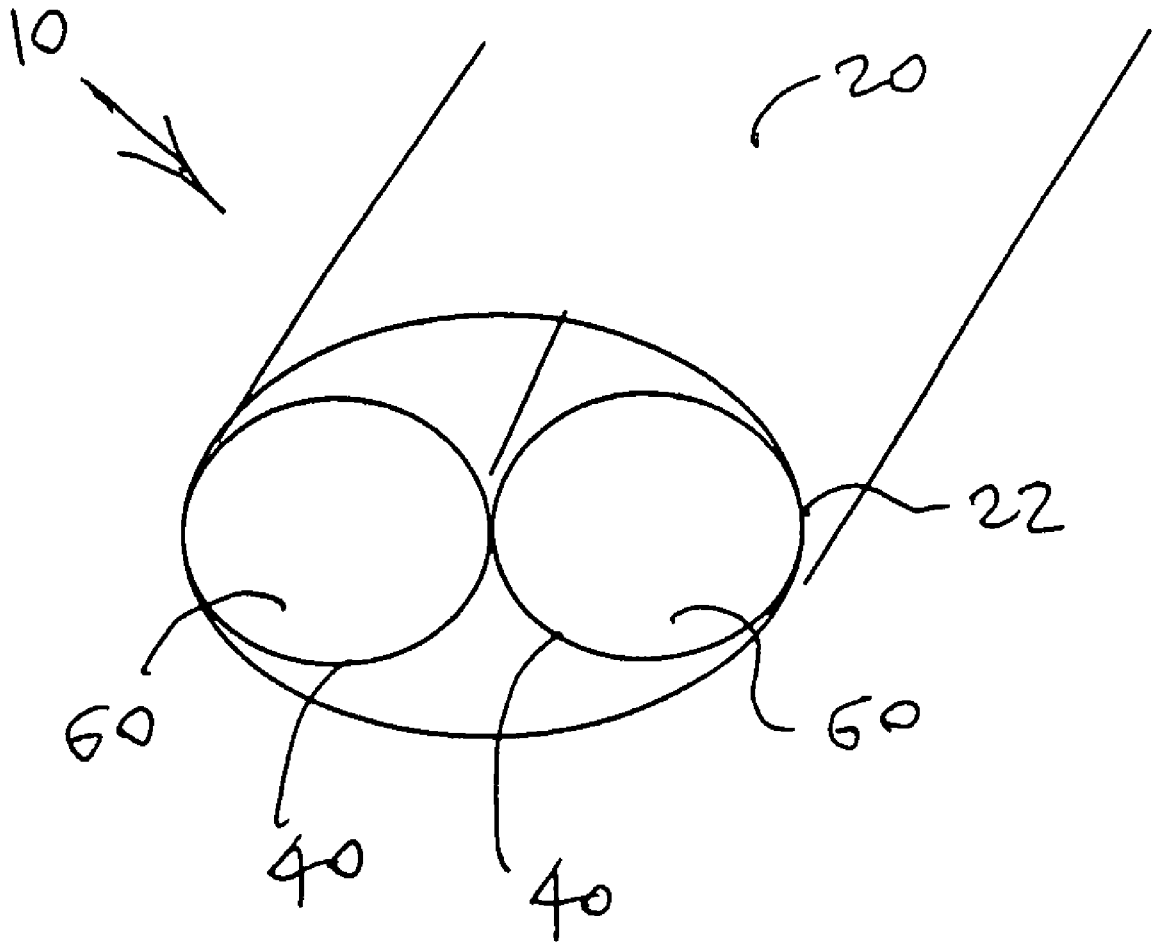
FIG. 8 is a view as in FIG. 7, except that the straw surrounding the barrels is elliptical rather than circular in cross-section.
Figure 9:
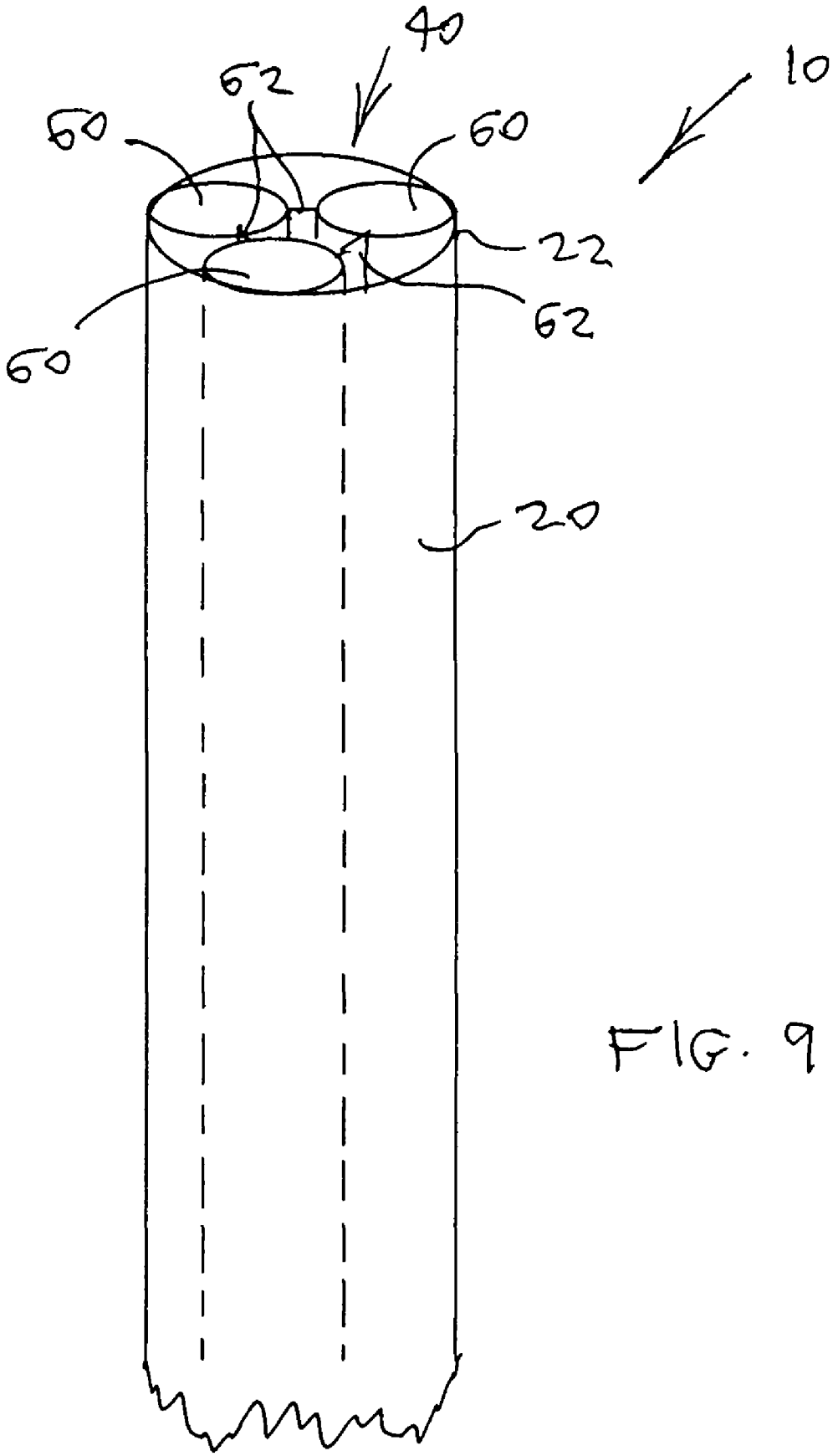
FIG. 9 is a broken away perspective end view of the tube first end, showing a debris blocking structure comprising three tubular barrels linked together by barrel interconnecting walls.

Yet another preferred embodiment of the debris blocking structure 40 includes two or more adjacent tubular barrels 60 fitted longitudinally inside and secured within the straw delivery tube 20. FIG. 6 shows two barrels 60 for longitudinal insertion and mounting within a straw delivery tube 20. FIG. 7 shows the two barrels 60 of FIG. 6 mounted within a straw delivery tube 20. FIG. 8 shows a straw delivery tube 20 surrounding the barrels 60 as in FIG. 8 except that the straw delivery tube 20 is of elliptical rather than circular in cross-section. FIG. 9 shows three tubular barrels 60 linked together by barrel interconnecting walls 62.

Figure 10:
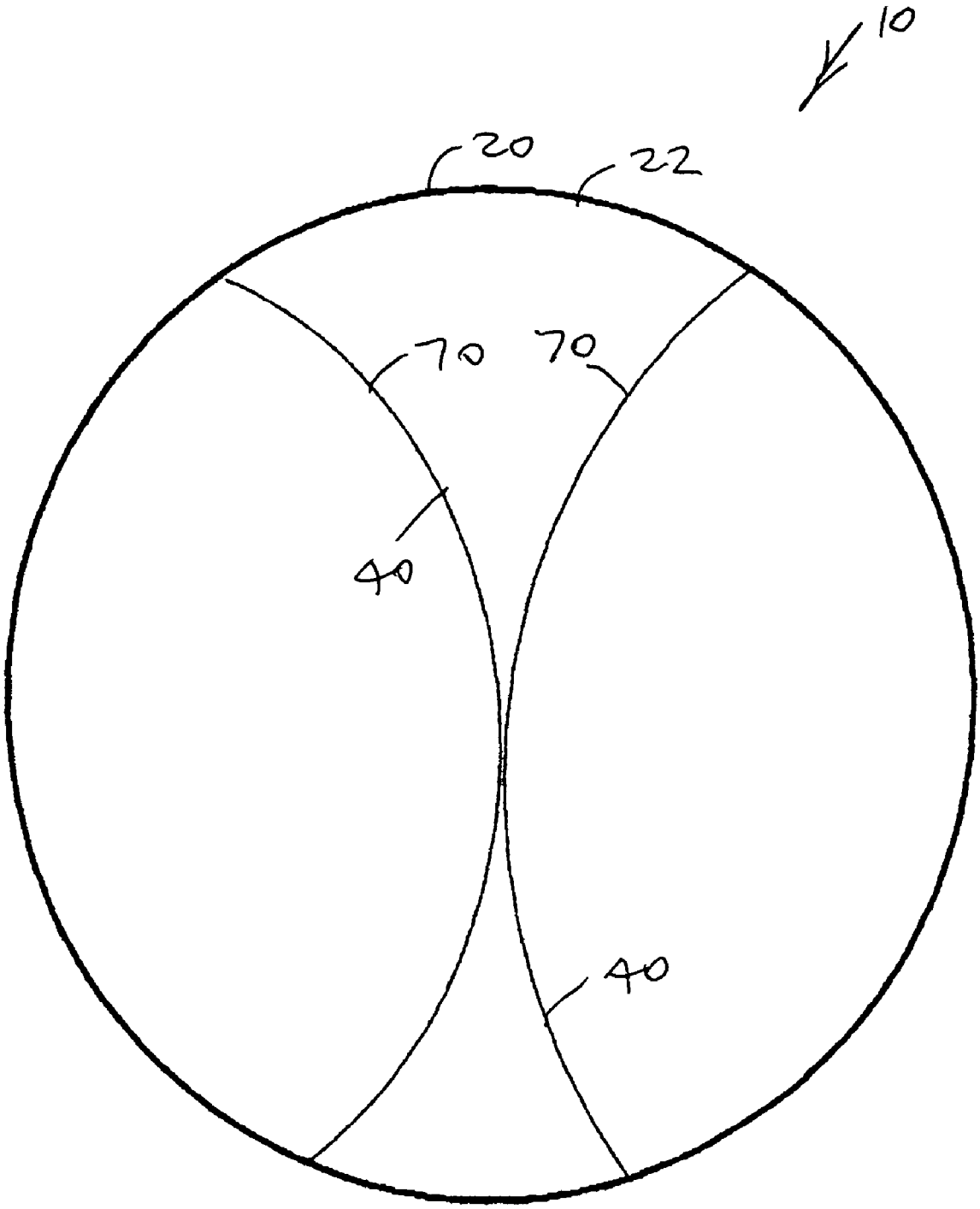
FIG. 10 is an end view of the straw delivery tube first end showing a modified version of adjacent tubular barrels, in which partial barrels are provided having semi-circular cross-sections.

FIG. 10 is an end view of the straw delivery tube first end 22 showing a modified version of adjacent tubular barrels, in which partial barrels 70 are provided having semi-circular cross-sections.

While the invention has been described, disclosed, illustrated and shown in various terms or certain embodiments or modifications which it has assumed in practice, the scope of the invention is not intended to be, nor should it be deemed to be, limited thereby and such other modifications or embodiments as may be suggested by the teachings herein are particularly reserved especially as they fall within the breadth and scope of the claims here appended.

I claim as my invention:

1. A method of drinking a beverage, comprising the steps of:

providing a vessel having a vessel opening;

providing a quantity of beverage within the vessel containing debris;

providing a safety drinking straw comprising a beverage delivery tube having a substantially circular tube cross-section and a tube first end and a tube second end; and a single debris blocking structure substantially at the tube first end permitting a free flow of the beverage through the delivery tube while preventing entry of debris of a selected minimum target size into the delivery tube, the single debris blocking structure comprising at least two intersecting partitions having line profiles across the delivery tube cross-section and extending longitudinally and continuously substantially the full length of the delivery tube;

inserting the tube first end through the vessel opening and into the beverage, so that the tube second end protrudes out of the vessel through the vessel opening;

and placing user lips around the tube second end and drawing some of the beverage through the delivery tube;

such that some of the debris in the beverage is drawn to the straw first end and abuts the debris blocking structure and is thereby prevented from entering the delivery tube and from lodging and becoming an obstruction within the delivery tube while beverage flows into the tube first end and through the delivery tube and out of the tube second end into a user mouth.

2. A method of drinking a beverage, comprising the steps of:

providing a vessel having a vessel opening;

providing a quantity of beverage within the vessel containing debris;

providing a safety drinking straw comprising a beverage delivery tube having a substantially circular tube cross-section and a tube first end and a tube second end; and a single debris blocking structure substantially at the tube first end permitting a free flow of the beverage through the delivery tube while preventing entry of debris of a selected minimum target size into the delivery tube; wherein the single debris blocking structure comprises two tube partitions having curved line profiles across the delivery tube cross-section and extending longitudinally and continuously substantially the full length of the delivery tube;

inserting the tube first end through the vessel opening and into the beverage, so that the tube second end protrudes out of the vessel through the vessel opening;

and placing user lips around the tube second end and drawing some of the beverage through the delivery tube;

such that some of the debris in the beverage is drawn to the straw first end and abuts the debris blocking structure and is thereby prevented from entering the delivery tube and from lodging and becoming an obstruction within the delivery tube while beverage flows into the tube first end and through the delivery tube and out of the tube second end into a user mouth.

3. The method of claim 2, wherein the debris blocking structure comprises at least two tubular barrels fitted longitudinally and in tandem inside and secured within the delivery tube.

4. The method of claim 3, wherein the tubular barrels are linked together by barrel interconnecting walls.

5. The method of claim 2, wherein the two tube partitions are arched across their width and open outwardly in different directions.

* * * * *